US006157132A

United States Patent [19]

Strok et al.

[11] Patent Number: 6,157,132

[45] Date of Patent: Dec. 5, 2000

[54] DISCHARGE LAMP EMISSION MATERIAL

[75] Inventors: Jack M. Strok, Garrettsville, Ohio; Balázs Nyiri, Budapest; István Csányi, Dunakeszi, both of Hungary

[73] Assignee: General Electric Company, Schenectady, N.Y.

[21] Appl. No.: 09/136,350

[22] Filed: Aug. 19, 1998

[51] Int. Cl.[7] ..... H01J 17/20

[52] U.S. Cl. ..... 313/637; 313/633; 313/491

[58] Field of Search ..... 313/633, 491, 313/571, 630, 637, 638, 639

[56] References Cited

U.S. PATENT DOCUMENTS

| | | | |
|---|---|---|---|
| 3,453,477 | 7/1969 | Hanneman et al. . | |
| 3,708,710 | 1/1973 | Smyser et al. | 313/213 |
| 3,849,690 | 11/1974 | Cosco et al. | 313/217 |
| 3,919,581 | 11/1975 | Datta | 313/345 |
| 4,076,992 | 2/1978 | Mark | 313/296 |
| 4,210,840 | 7/1980 | Bhalla | 313/218 |
| 4,319,158 | 3/1982 | Watanabe et al. | 313/346 |
| 4,479,074 | 10/1984 | Bhalla | 313/628 |
| 4,617,492 | 10/1986 | Luthra | 313/630 |
| 4,620,128 | 10/1986 | Luthra | 313/630 |
| 4,929,418 | 5/1990 | Branovich et al. . | |
| 5,111,108 | 5/1992 | Goodman et al. | 313/630 |

*Primary Examiner*—Vip Patel
*Attorney, Agent, or Firm*—Fay, Sharpe, Fagan, Minnich & McKee, LLP

[57] ABSTRACT

A vapor discharge lamp comprised of an arc tube containing an ionizable medium, a first electrode electrically connected to a first in lead conductor, and a second electrode electrically connected to a second in lead conductor, said first and said second electrode pairs being positioned to create an arc discharge therebetween, an electron emissive material disposed on at least one of said electrodes, said electron emissive material being $Ba_4Al_2O_7$.

7 Claims, 3 Drawing Sheets

DISCHARGE LAMP EMISSION MATERIAL

BACKGROUND OF THE INVENTION

The present invention relates generally to discharge lamps. More particularly, the invention relates to an improved electron emissive material for the electrodes of such lamps.

The present invention will be described primarily in the context of a sodium vapor discharge lamp. However, the intended scope of the invention is not limited to such lamps but also covers other vapor discharge lamps, including without limitation, HCRI sodium, unsaturated vapor sodium, fluorescent, and high pressure mercury. Moreover, the present emission mix is suited to any discharge lamp in which an alkali metal is present in the vapor phase.

One of the primary requirements in a vapor discharge lamp is the establishment of the arc. To facilitate this step in the process of creating light, the electron emitting electrodes used in most discharge lamps are treated with a coating of an emission material, generally a refractory powder mixture, which lowers the work function of the electrode so that a lower voltage may be used to start the arc. The process of lowering the starting voltage by applying lower work-function materials on the electrode surface is known as "activation" and an extensive understanding of cathode activation theory and practice has developed. In fact, many electrodes used in devices unrelated to vapor discharge lamps include materials to lower the work function, see U.S. Pat. No. 3,849,690.

An early understanding of "activation" resulted from use of certain materials with the cathode of a vacuum tube. For example, U.S. Pat. No. 4,076,992 discloses the use of a barium oxide, aluminum oxide, and calcium oxide emission mix. However, this disclosure does not contemplate the generation of light. Discussion of the generation of light through electron initiated discharge and the associated use of an emission mixture is found in U.S. Pat. Nos. 3,026,177; 3,026,210; 3,453,477; 3,485,343; 3,708,710; 3,935,494; 4,052,641; 4,079,167; 4,150,317; 4,155,758; 4,251,569; 4,285,372; 4,313,854; 4,319,158; 4,374,339; 4,468,586 and 4,620,128. Each of these patents is herein incorporated by reference.

One the major factors limiting the life of lamps employing a sodium discharge is the loss of sodium from the discharge. When the loss of sodium from the vapor phase in the lamp is too large, the color and light output become unsuitable. Thus, although the lamp operates well initially, the useful life of the lamp may be so limited as to be impractical.

In addition, electrode emission materials used in the standard HPS lamps have relatively high sodium consumption rates but it does not affect the claimed lamp life, 24000 hours, due to the relatively high sodium content. The disadvantage of these lamps is that they also have a high Hg content which gives rise to the familiar and annoying cycling behavior at the end of the lamp life. To avoid cycling, the mercury and sodium doses must be reduced by factor of 5 to 10 and all the sodium loss mechanisms must be reduced in order to achieve longer life.

Early electrode emissive material, in fact, one now in general use in the lighting industry for standard HPS lamps, is comprised of barium calcium tungstate as described in U.S. Pat. No. 4,617,492. Nonetheless, the standard tungstate emissive materials are too reactive with sodium to provide long life and non-cycling HPS lamps.

Along these lines, U.S. Pat. No. 5,111,108 describes an emission mix intended to provide very low sodium reactivity. More particularly, this patent describes an emissive material comprised of a reacted mixture of barium-strontium-yttrium oxides. Although this composition is believed to provide certain benefits, it also has been recognized that commercial synthesis of phase pure compounds of these oxides can be difficult, and the yttrium component is relatively rare and therefore expensive.

In copending U.S. Ser. No. 08/796,669 it is disclosed that $Ba_3Al_2O_6$ provides a superior electron emission mix for a sodium vapor discharge lamp. Nonetheless, it remains desirable in this art to have an effective alternate emission mix which lowers the required start-up voltage yet is resistant to reaction with sodium in the vapor discharge. The present invention, utilizing a different oxide of barium and aluminum has unexpectedly demonstrated superior results with respect to reactivity with sodium.

SUMMARY OF THE INVENTION

It is an object of this invention to provide a new and improved emission mix, effective in reducing the start-up voltage of a lamp and having a low chemical reactivity with alkali metals.

It is an advantage of the present invention to provide a sodium vapor discharge lamp having a low voltage starting requirement and a long life.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims. To achieve the foregoing object in accordance with the purpose of the invention, the emission mix is an oxide comprised of barium and aluminum. A particularly preferred form of the invention is an emission mix compound having the formula $Ba_4Al_2O_7$.

It is surprising that the present inventive emission mix is superior to $Ba_3Al_2O_6$ because of the skilled artisan's expectation that an increase in the metal atoms making up the compound typically results in undesirable rapid decomposition of the compound.

The present invention is also directed to a sodium vapor discharge lamp including at least one electrode comprised of tungsten and an emission mix comprised of $Ba_4Al_2O_7$.

BRIEF DESCRIPTION OF THE DRAWINGS

The description of the invention which follows will be aided by reference to the accompanying drawings in which.

DETAILED DESCRIPTION OF THE PREFERRED EMBODIMENTS

Reference will now be made in detail to the present preferred embodiment of the invention. While the invention will be described in connection with a preferred embodiment, it will be understood that it is not intended to limit the invention to that particular embodiment. On the contrary, it is intended to cover all alternatives, modifications and equivalents as may be included within the spirit and scope of the invention defined by the appended claims.

Of course, the described lamp construction is for example purposes only. Moreover, any type of lamp design incorporating an emission mix may benefit from the present invention. In this regard, the lamps described in U.S. Pat. Nos. 4,808,876; 4,467,238; 5,479,072; 4,972,120; 4,757,236; 4,605,881; 4,783,615; 4,459,513; 4,839,565; 5,336,968; 4,620,129; 4,617,492; 3,248,590; 5,367,228, incorporated by reference, are herein believed particularly suited for use with the present invention.

Figure 1:
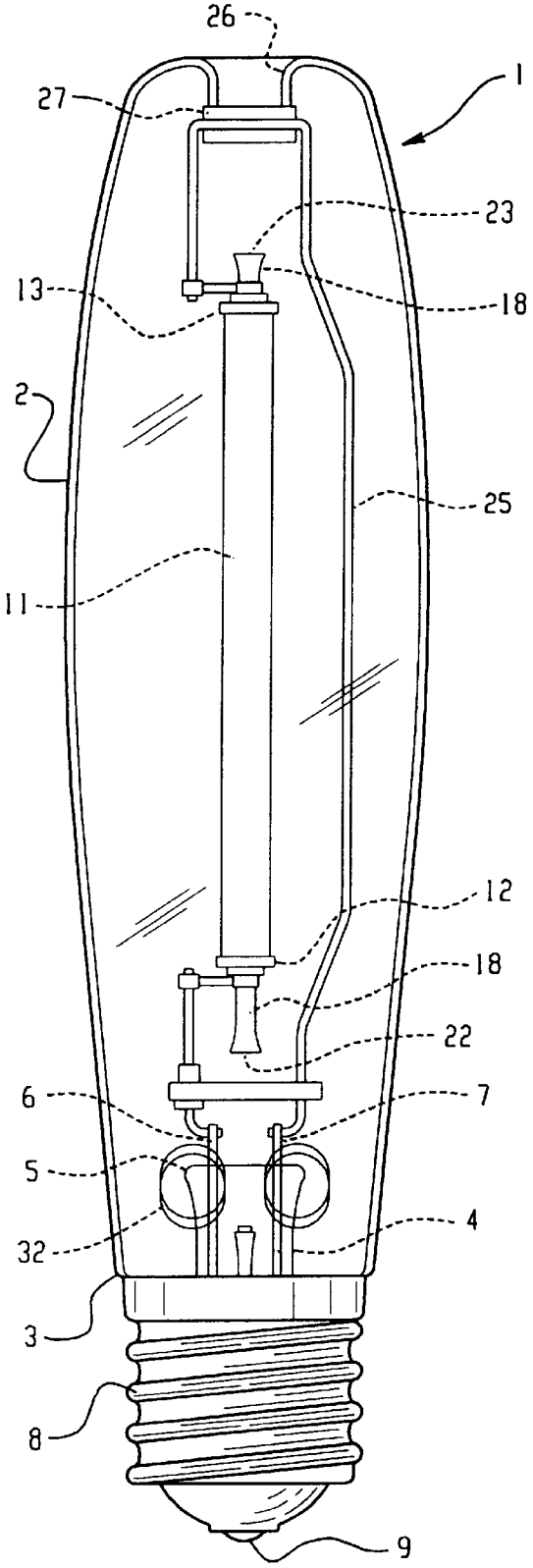
FIG. 1 is a schematic view of a jacketed high pressure sodium vapor lamp suitable for use in combination with the inventive emission mix.
Figure 2:
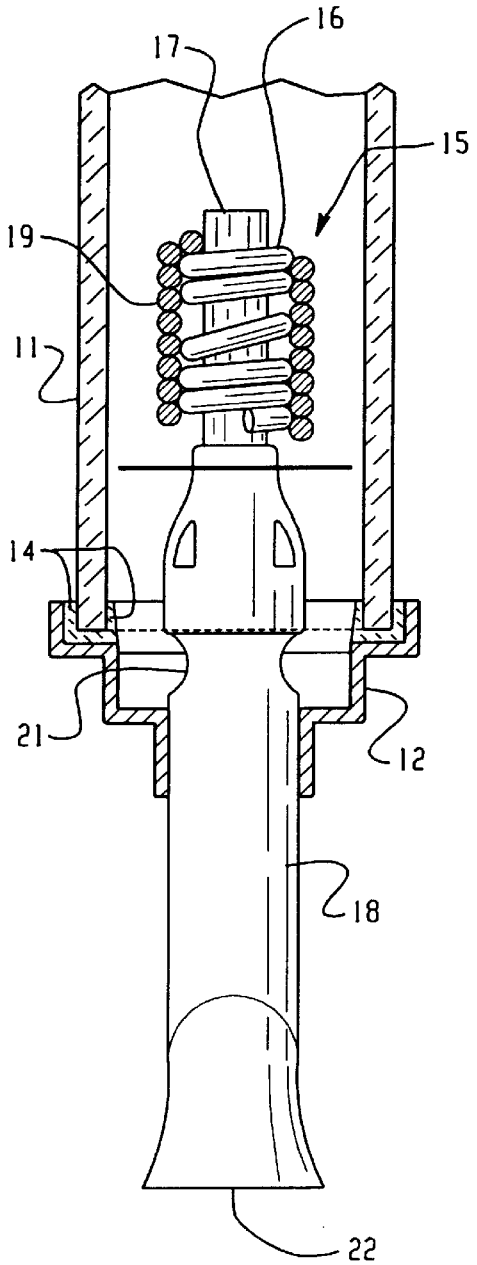
FIG. 2 is a sectional view of the electrode for the lamp of FIG. 1.
Figure 3:
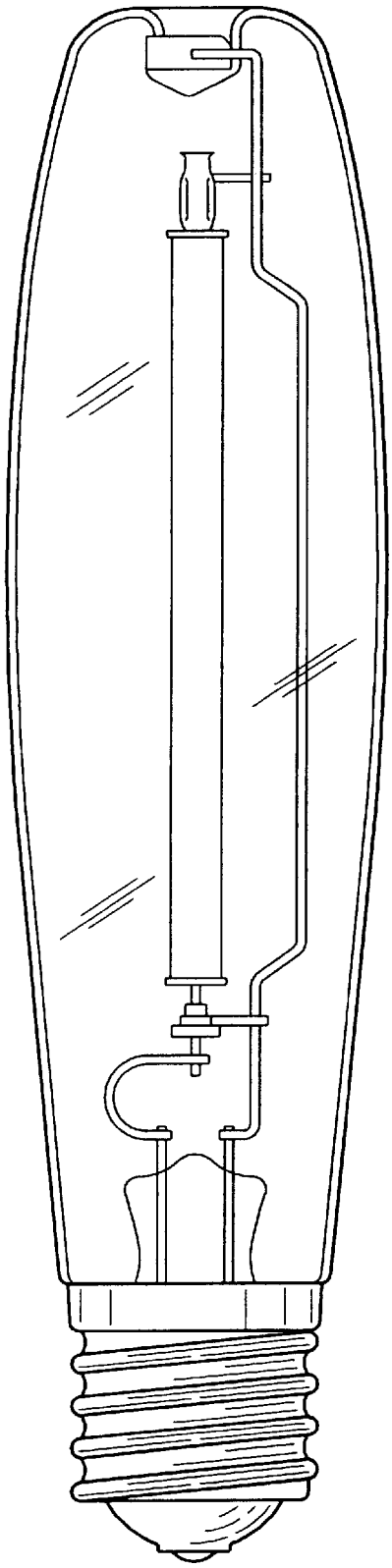
FIG. 3 is a schematic view of an alternate lamp design.

A high intensity sodium vapor discharge lamp with which the inventive emission mix of the subject application may be utilized is illustrated in FIGS. 1, 2 and 3. Lamp 1 is constructed of an outer vitreous envelope or jacket 2 of a elongated cylindrical shape. Neck 3 of the jacket 2 is closed by an entrance stem 4 having a press seal 5 through which extends stiff in-lead wires 6 and 7, connected themselves at their outer ends to the threaded shell 8 and center contact 9 of a conventional screw base. Inner envelope or arc tube 11 is made with a sintered high density polycrystalline alumina material to provide increased in-line optical transmission. The ends of the tube are closed by niobium metal caps 12 and 13 which have been hermetically sealed to the alumina arc tube 11 by means of a glass sealing composition which is shown, although exaggerated in thickness, at 14 in FIG. 2.

Thermionic electrodes 15 are mounted at the ends of the arc tube. As best seen in FIG. 2, the electrode comprises an inner tungsten wire coil 16 which is wound over tungsten shank 17, crimped or welded in the end of a niobium tube 18 which is in turn is welded to the end cap 12. The central turns of the inner coil 16 are spaced apart and the outer tungsten wire coil 19 is screwed over the inner coil.

Heretofore, a suitable emission mix such as those described in U.S. Pat. Nos. 3,708,701; 3,919,581; or 4,617,492, herein incorporated by reference, have been applied to the electrode coils by painting or alternatively by dipping the coils in a suspension containing the emissive mix. The material is retained primarily in the interstices between the turns of the outer and inner coil and the inner coil and shank. The present inventive composition is suited to application in the same manner and the same locations as has been performed previously.

Continuing now with the description of a suitable high pressure sodium vapor lamp, a lower tube 18 is pierced through a 21 and is used as an exhaust tube during manufacture of the lamp. After the starting gas fill and sodium-mercury amalgam have been introduced into the arc tube, exhaust tube 18 is pinched off by a weld at 22, serving thereafter as a reservoir for condensed sodium-mercury amalgam. Upper tube 18 has no opening in the arc tube and is used to contain a small amount of yttrium metal (not shown) which serves as a getter; the end of the tube is closed by pinch 23 which forms a hermetic seal.

The arc tube is supported within the outer envelope by means of a mount comprising a single rod 25 which extends the length of the envelope from in lead 7 at the stem end to a dimple 26 at the dome end to which it is anchored by a resilient clamp 27. End cap 13 of the improved arc tube is connected to the frame by band 29 while end cap 12 is connected to in lead 6 through band 30 and support rod. The inner-envelope space is desirably evacuated in order to conserve heat. The evacuation is done prior to sealing off the jacket. A getter, for example comprised of barium aluminum alloy powder pressed into a channeled ring is used in order to achieve a high vacuum.

Of course, the invention is not limited to this particular sodium lamp, or in fact, a sodium discharge lamp of any type. More specifically, the present inventive emission mixture is believed to be effective with any vapor discharge lamp in which an alkali metal is present.

U.S. Pat. No. 3,708,710, herein incorporated by reference, teaches the combination of a high pressure, sodium vapor lamp (HPS) in which an electron emission material is incorporated. As depicted in this patent, di-barium calcium tungstate is disclosed as an excellent electron-emitting material for use in high intensity discharge lamps. However, as pointed out in U.S. Pat. No. 4,617,492, an oxide of this type can cause sodium loss by chemical reaction.

As demonstrated in the following comparative examples, the present invention demonstrates unexpected superiority of $Ba_4Al_2O_7$.

EXAMPLES

A $Ba_2CaWO_6$ emission mixture was evaluated in the form of commercially available 70 watt/90 volt lamps (Lucalox™ standard LU 70/90).

A $Ba_3Al_2O_6$ emission material mix was prepared from Mellor alpha $Al_2O_3$ (0.3 micron) and reagent grade $BaCO_3$ (J. T. Baker), to yield 0.400 kg of product. The reactants were wet-mixed in 0.60 liters of distilled water containing 4 drops of pure Triton X-100 surfactant, using a motor-driven, plastic-coated propeller. Following 30 minutes of intense mixing, the slurry was reduced to dryness by evaporation of the water in a forced air electric oven at 120° C. overnight. The dried powder was screened −40 mesh using a Nylon screen.

The dried powder was split equally between two 0.600 liter high purity, high density, alumina crucibles, each covered, with a lid of the same material that was raised slightly to allow easy venting with $CO_2$ during the reaction. The materials were given two high temperature reactions. The first was a heating to 1400° C. at 50C/hour, holding temperature for 20 hours, then cooling to room temperature at 100° C./hour. The products of this first reaction were slightly collapsed in volume. They were then lightly mortar and pestle comminuted and passed through a 40 mesh Nylon screen. This mixture was then reacted two more times, each reaction using a heating rate of 100° C./hour to a maximum temperature of 1450° C., with 20 hour holds at temperature, separated by a comminution and screening. Analyses with a MPD 188 Automatic Powder Diffractometer showed the reaction had gone substantially to completion following the third reaction, as demonstrated by a sharpening of the $Ba_3Al_2O_6$ lines. The product was given a final comminution and screening before incorporation into a lamp.

A $Ba_4Al_2O_7$ emission mix was prepared according to the following procedure. Starting materials were (a) Merck gamma alumina ($Al_2O_3$), catalog no. 1.010955.1000, with ignition loss upon firing of <1,0%, and 70% of the particles between 0.063–0.200 mm, and (b) reagent grade $BaCO_3$. Batch size was approximately 200 g. The ingredients were mixed dry for 15 minutes, and fired at a rate of 20C/min to 800C, then 10C/min to 1300C. Reaction time at 1300C was 120 minutes, in a covered alumina crucible with nitrogen atmosphere. The Supertherm Model RHT 08/16 furnace was switched off, and allowed to cool to room temperature. The fired material was ground in a Fritsch Pulverisette Model 5 3-stage machine for 30 minutes. X-ray diffraction confirmed the $Ba_4Al_2O_7$ main phase, and the phase purity.

Sample Lamp Construction

In order to compare the standard di-barium calcium tungstate emission mix to the $Ba_3Al_2O_6$ and $Ba_4Al_2O_7$ mixes, test lamps were made from standard 70 watt/90 volt high pressure sodium lamps by substituting $Ba_3Al_2O_6$ and $Ba_4Al_2O_7$ for $Ba_2CaWO_6$.

The electrode coating process which was used, was a 'dry' process using ultrasonic equipment in air. After coating the electrodes they were sintered in an inert argon atmosphere using the following parameters:

furnace type:

VBK 50 temperature:

1650° C.

sintering time at 1650° C.:

15 mins.

Each test lamp with a barium aluminate emission mix was dosed with only 50 μg Na and 950 μg Hg. Each lamp was burned for 1,000 hours and then the percent of original light output as measured by lumens and the sodium D-line self-reversal width were determined.

It is noted that a suitable sodium dose for non-cycling 70 watt/90 volt HPS lamps is only about 1/10 of the typical commercial lamp. The test lamps with barium aluminates were dosed with only about 1/7 the quantity of sodium suitable for non-cycling 70 watt/90 volt HPS lamps. By using such a low quantity of sodium, the lamps were significantly more sensitive to sodium loss, making a 1,000 hour evaluation period highly predictive. Clearly, the results indicated that the present inventive emission mix is less likely to scavenge sodium, demonstrating its particular effectiveness in a sodium vapor environment.

Particularly, the standard $Ba_2CaWO_6$ lamps (3400 μg dosed sodium) lost sodium at an estimated rate of 133 μg/khr with a predicted total loss of 3250 μg after 24 khr. The $Ba_3Al_2O_6$ lamps lost sodium at an estimated rate of 60 μg/khr with a predicted total loss of 1460 μg after 24 khr. The $Ba_4Al_2O_7$ lamps lost sodium at the rate of 30 μg/khr with a predicted total loss of 740 μg after 24 khr.

Figure 4:
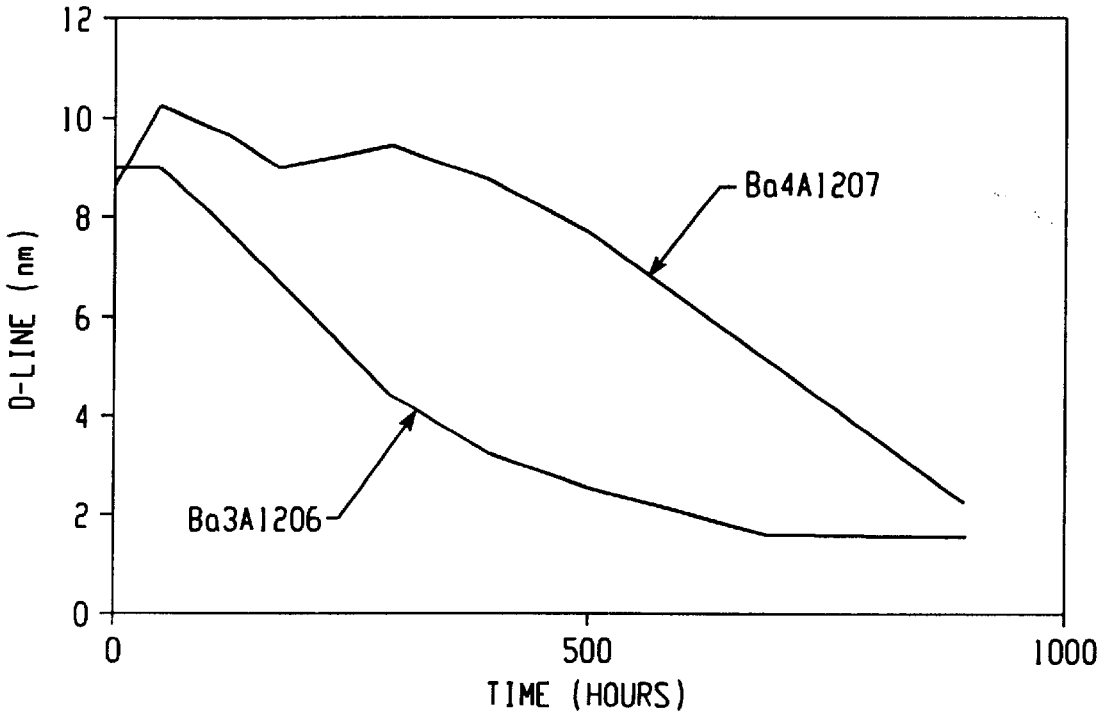
FIGS. 4 and 5 are graphical representations comparing emissive materials $Ba_3Al_2O_6$ and $Ba_4Al_2O_7$.
Figure 5:
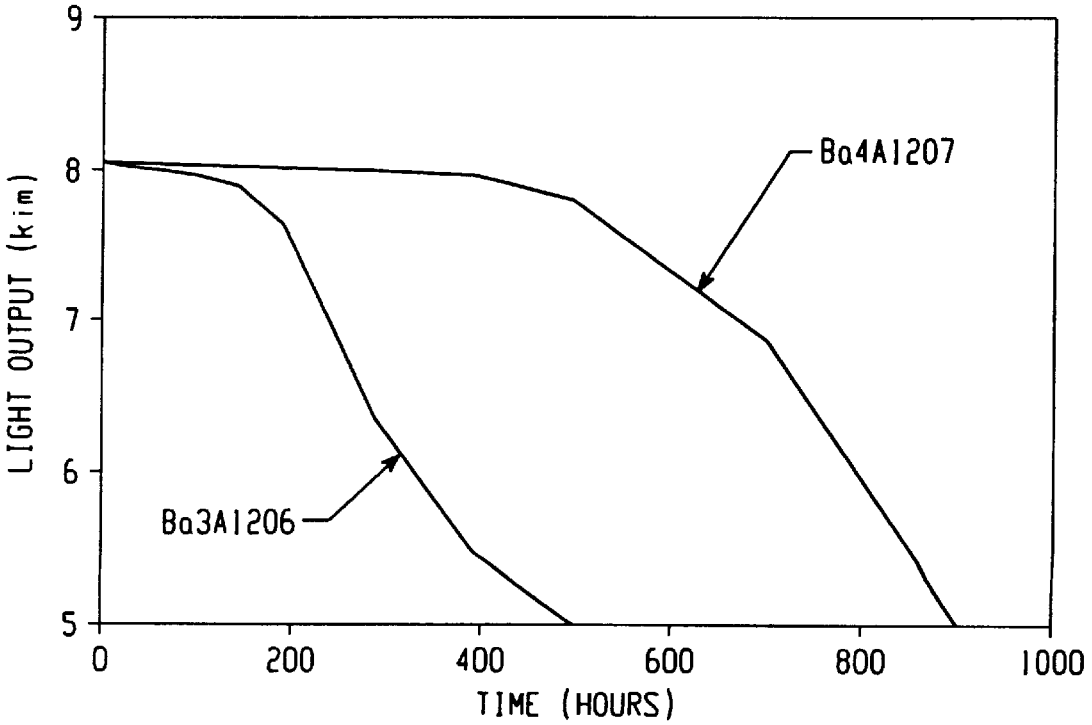

Experiments directly comparing the electrode emissive materials $Ba_3Al_2O_6$ and $Ba_4Al_2O_7$ have shown that the rate of sodium loss is decreased by 50% with the $Ba_4Al_2O_7$ material. FIGS. 4 and 5 further show the results of the accelerated tests. In addition, five non-cycling lamp types of different wattages, 30 pieces of each wattage, have been built with $Ba_4Al_2O_7$ and burned for 5000 hours without any electrode emission problems.

Thus it is apparent that there has been provided in accordance with the invention, a sodium vapor discharge lamp that fully satisfies the objects, aims and advantages set forth above. While the invention as been described in conjunction with the specific embodiments thereof, it is evident that many alternatives, modifications and variations will be apparent to those skilled in the art in light of the foregoing description. Accordingly, it is intended to embrace all such alternatives, modifications and variations that fall within the spirit and broad scope of the appended claims.

What we claim is:

1. A vapor discharge lamp comprised of:

an arc tube containing an ionizable medium, a first electrode electrically connected to a first in lead conductor, and a second electrode electrically connected to a second in lead conductor, said first and said second electrode pairs being positioned to create an arc discharge therebetween, an electron emissive material disposed on at least one of said electrodes, said electron emissive material comprising $Ba_4Al_2O_7$.

2. The lamp of claim 1, wherein said ionizable medium includes an alkali metal.

3. The lamp of claim 1 wherein said ionizable medium includes sodium.

4. The lamp of claim 1 wherein said ionizable medium includes mercury.

5. The lamp of claim 3 wherein said sodium comprises less than 1500 micrograms of said ionizable medium.

6. A vapor discharge lamp having an electrode including $Ba_4Al_2O_7$, wherein said $Ba_4Al_2O_7$ is in the form of a coating.

7. The electrode of claim 6 being comprised substantially of a metal and including $Ba_4Al_2O_7$ dispersed therein.

* * * * *